US008757377B2

(12) United States Patent
Alexander et al.

(10) Patent No.: US 8,757,377 B2
(45) Date of Patent: Jun. 24, 2014

(54) SECURITY HANGER TAG FOR SAW BLADE

(75) Inventors: Brian K. Alexander, Waukesha, WI (US); Glenn Meyers, Greenfield, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 0 days.

(21) Appl. No.: 13/475,929

(22) Filed: May 18, 2012

(65) Prior Publication Data

US 2013/0020217 A1 Jan. 24, 2013

Related U.S. Application Data

(60) Provisional application No. 61/488,296, filed on May 20, 2011.

(51) Int. Cl.
*B65D 85/00* (2006.01)

(52) U.S. Cl.
USPC ..... 206/349; 206/493; 206/1.5

(58) Field of Classification Search
USPC ..... 206/349, 493, 1.5, 806, 807; 70/57.1, 70/61; 40/658, 647, 648
See application file for complete search history.

(56) References Cited

U.S. PATENT DOCUMENTS

| | | | | | |
|---|---|---|---|---|---|
| 3,804,238 | A * | 4/1974 | Howard | 206/459.5 |
| 3,974,581 | A | 8/1976 | Martens et al. | |
| 4,359,158 | A * | 11/1982 | Gringer | 206/349 |
| 4,523,356 | A | 6/1985 | Charlot, Jr. | |
| 4,603,453 | A | 8/1986 | Yokoyama | |
| 5,031,287 | A | 7/1991 | Charlot, Jr. et al. | |
| 5,044,591 | A * | 9/1991 | Huang | 248/317 |
| 5,078,266 | A * | 1/1992 | Rackley | 206/349 |
| 5,594,228 | A | 1/1997 | Swartz et al. | |
| 5,713,467 | A * | 2/1998 | Kao | 206/349 |
| 5,988,381 | A * | 11/1999 | Ling | 206/349 |
| 6,164,447 | A * | 12/2000 | Svetlik | 206/373 |
| D478,833 | S | 8/2003 | Belden, Jr. et al. | |
| 6,631,629 | B1 | 10/2003 | Fuss et al. | |
| 6,729,468 | B1 * | 5/2004 | Dobmeier | 206/303 |
| 7,055,689 | B2 * | 6/2006 | Chen | 206/376 |
| 7,624,865 | B2 * | 12/2009 | Pendergraph et al. | 206/379 |
| 7,815,044 | B2 * | 10/2010 | Kasubowski et al. | 206/349 |
| 8,069,983 | B2 * | 12/2011 | Cross | 206/349 |
| 8,248,236 | B2 * | 8/2012 | Perez et al. | 340/568.1 |
| 2002/0162763 | A1 * | 11/2002 | Chow | 206/349 |
| 2005/0133389 | A1 * | 6/2005 | Baublitz et al. | 206/303 |
| 2006/0174667 | A1 | 8/2006 | Garner | |
| 2009/0261005 | A1 * | 10/2009 | Kasubowski et al. | 206/349 |

* cited by examiner

*Primary Examiner* — Steven A. Reynolds
(74) *Attorney, Agent, or Firm* — Michael Best & Friedrich LLP

(57) ABSTRACT

A device for securing and displaying a saw blade, the device including a body portion having a first through hole adapted to receive a hanger, a cavity for housing a security device, and a locating profile. The device also includes a cover including a second through hole. The body portion and the cover are one structure coupled by a hinge such that the post extends from one of said body portion or said cover, and an aperture in the other of said body portion and said cover. The post is also adapted to extend through the saw blade into the aperture to secure the saw blade to the device. The through holes are aligned when the post extends through the aperture and the aligned through holes are adapted to house a security hanger.

14 Claims, 5 Drawing Sheets

SECURITY HANGER TAG FOR SAW BLADE

BACKGROUND

The present invention relates to saw blades, and more particularly to a hanger tag for security and display purposes.

SUMMARY

In one embodiment, the invention provides a device for securing and displaying a saw blade. The device includes a body portion having a first through hole adapted to receive a hanger, a cavity for housing a security device, and a locating profile. The device further includes a cover including a second through hole. The body portion and the cover are one structure coupled by a hinge such that the post extends from one of said body portion or said cover, and an aperture in the other of said body portion and said cover. The post is also adapted to extend through the saw blade into the aperture to secure the saw blade to the device. The through holes are aligned when the post extends through the aperture and the aligned through holes are adapted to house a security hanger.

In another embodiment the invention provides security and display device, the device including a saw blade having an aperture and a tang. The device also includes a body including a locating profile, a first through hole adapted to receive a hanger, a post having a flange on a distal end, and a cover secured to the body by a hinge and having a second through hole. The cover further includes a rim that engages the recess an aperture. The flange has a larger diameter than the aperture. The post is adapted to extend through the aperture of the saw blade into the aperture to secure the saw blade to the device. Further, the through holes are aligned when the post extends through the aperture and the aligned through holes are adapted to house a security hanger.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1A:
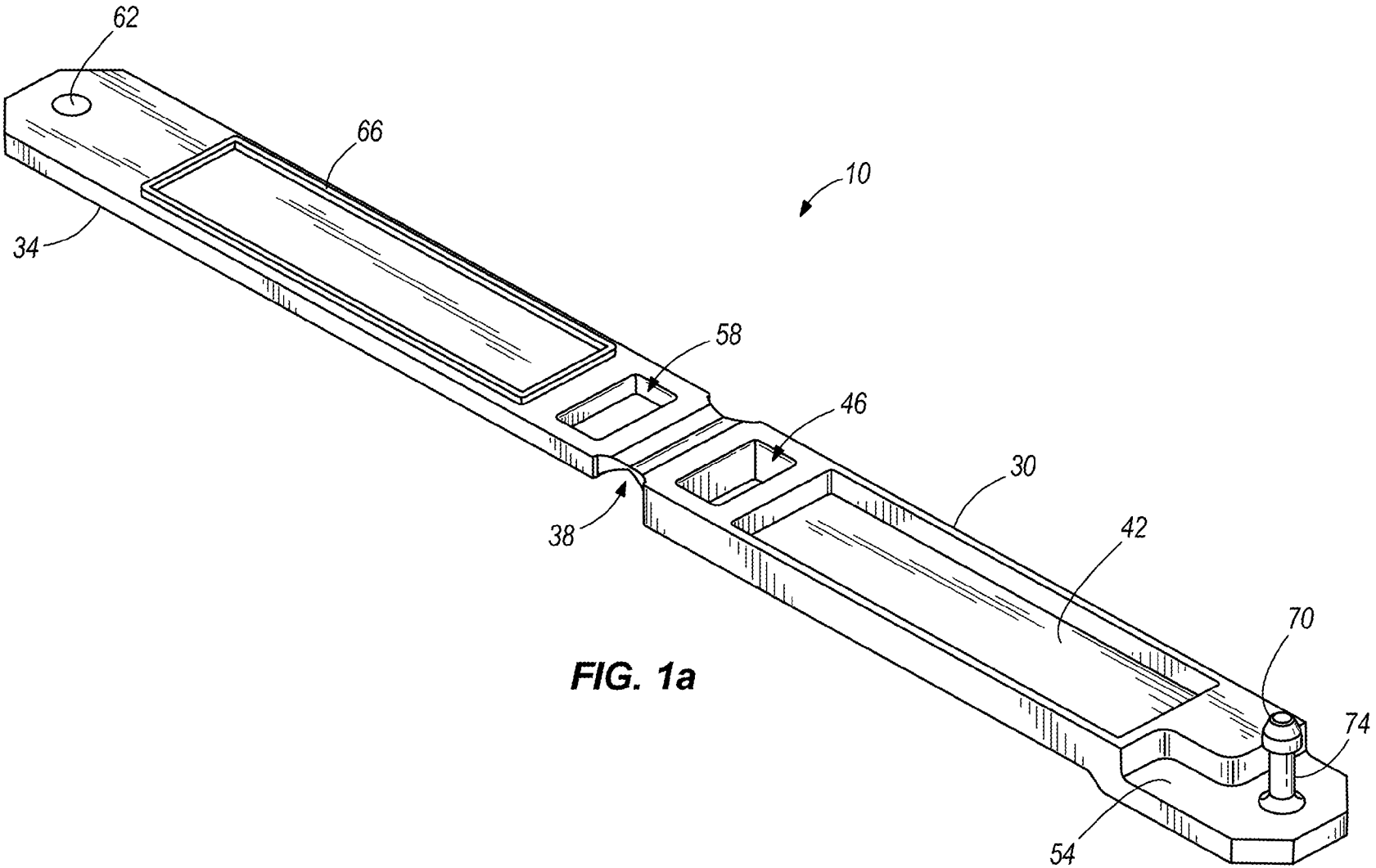
FIG. 1*a* illustrates a perspective view of a security hanger tag for a saw blade according to one embodiment of the invention.
Figure 1B:
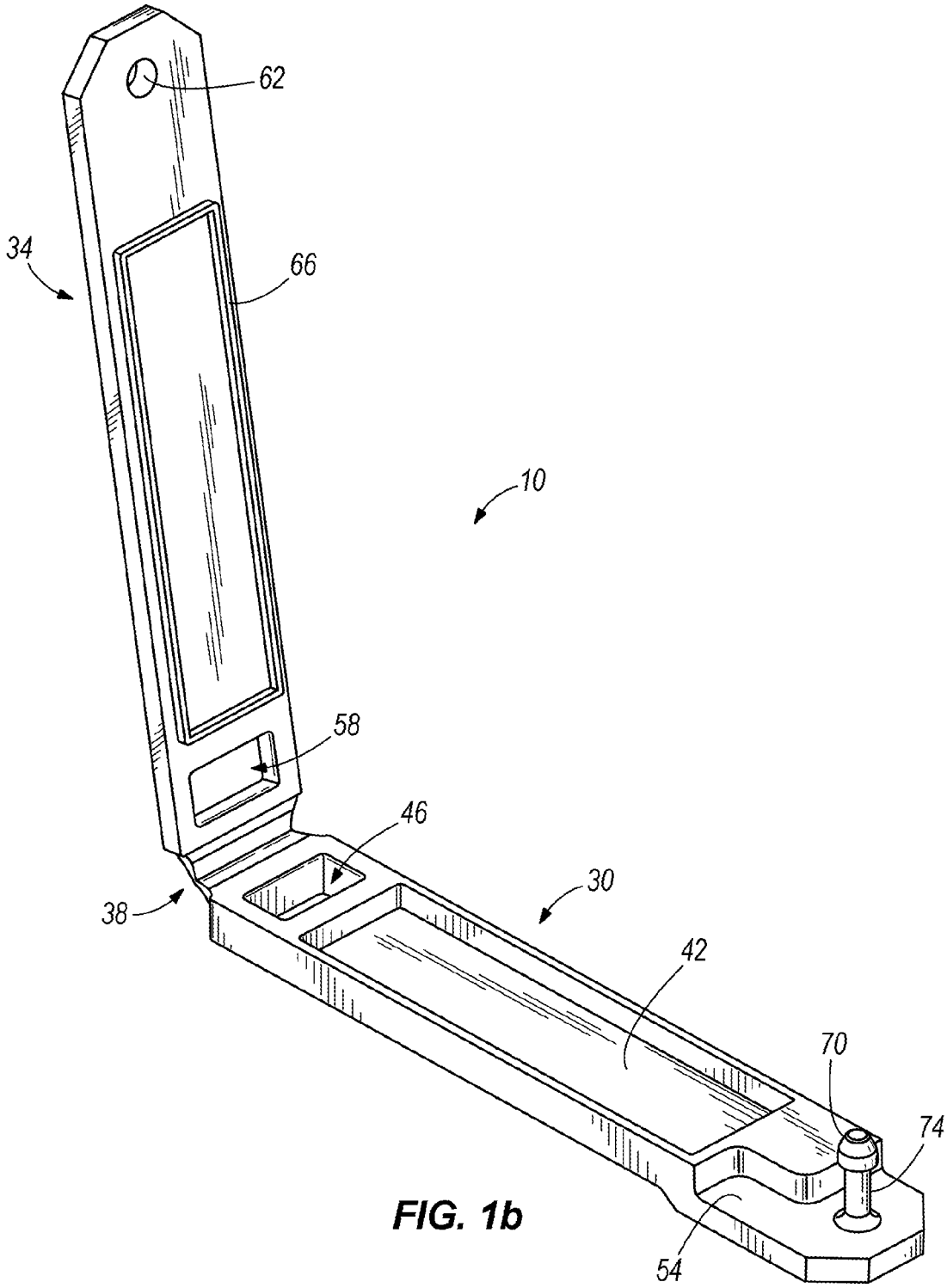
FIG. 1*b* illustrates an additional perspective view of the security hanger tag for a saw blade of FIG. 1*a*.
Figure 2:
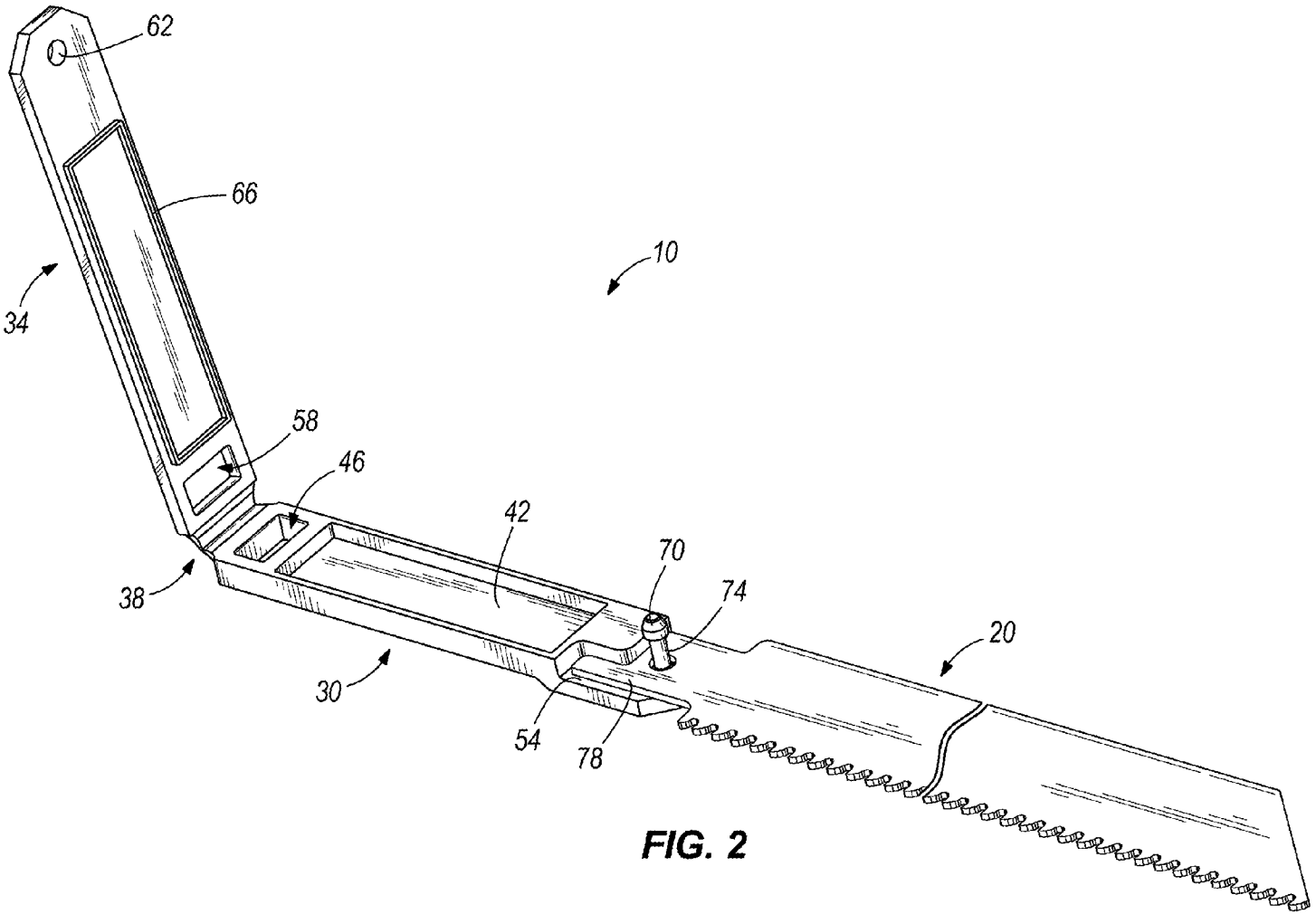
FIG. 2 illustrates a perspective view of the security hanger tag for a saw blade of FIG. 1*a* having a saw blade coupled to the tag.
Figure 3:
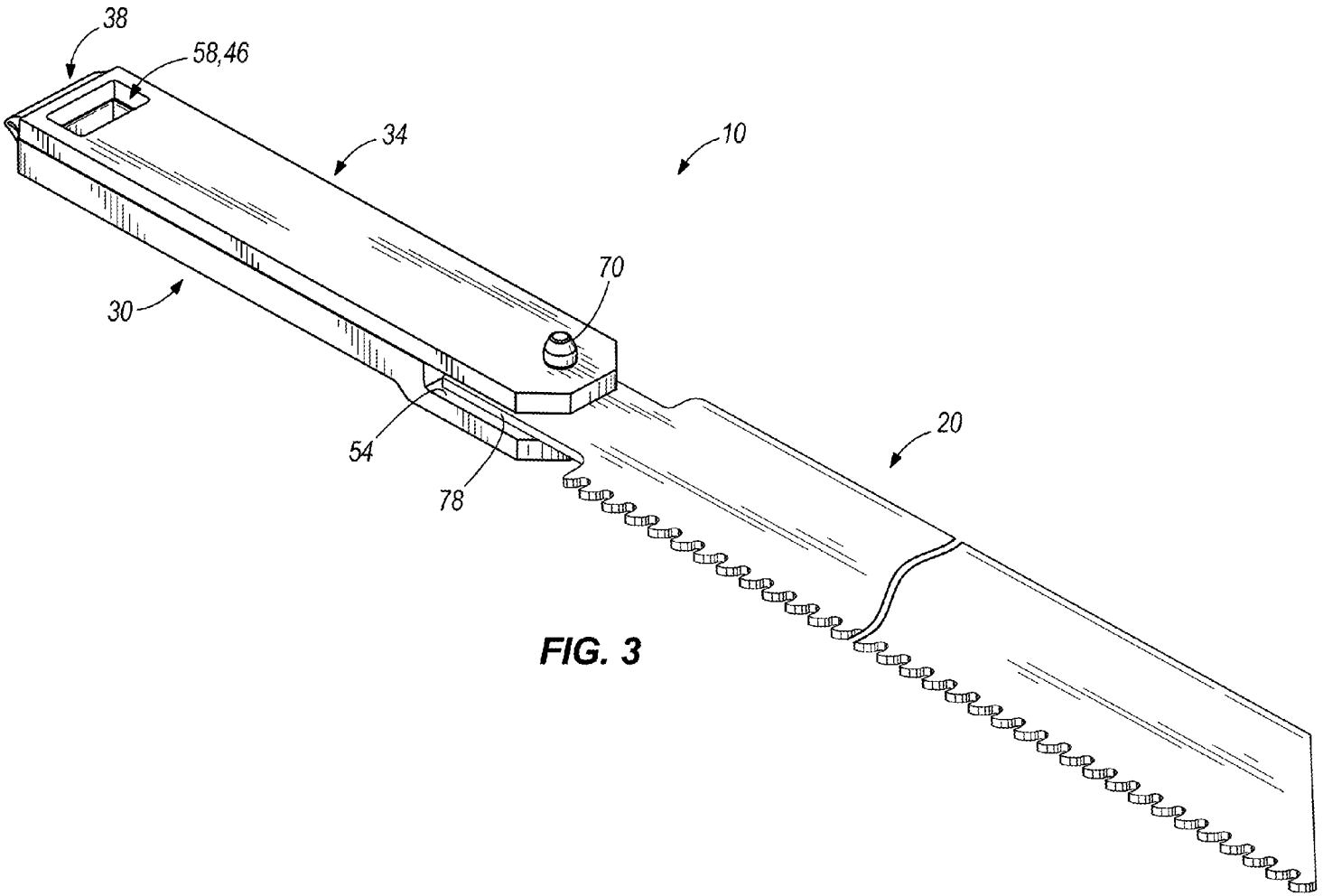
FIG. 3 illustrates an additional perspective view of the security hanger tag for a saw blade f FIG. 1*a*.

Embodiments of the invention described herein relate to a molded packaging device to hold and display a reciprocal saw blade. The packaging device provides a tamper resistant security device while still permitting visual and tactile inspection of the saw blade prior to purchase by a consumer. FIGS. 1, 2, and 3 illustrate a security hanger tag 10, or hanger tag, according to one embodiment of the invention and for use with a reciprocating saw blade 20 (shown in FIGS. 2 and 3). The hanger tag 10 includes a body 30 connected to a cover 34 by a hinge 38. The hanger tag 10 has a unitary body, such that the body 30, cover 34, and hinge 38 are injection molded as a single piece of polymer material. Accordingly, the integral hinge 38 is of the type commonly referred to a "living hinge." The hanger tag 10 may be molded from ABS, acrylic, nylon, polycarbonate, polypropylene, PVC, or other suitable material. In further embodiments, the hanger tag 10 may be molded from a fiber reinforced material. In still further embodiments, the hanger tag 10 may be molded from a biopolymer, or a natural fiber reinforced biocomposite material. In yet further embodiments, the body 30 and cover 34 may be separate and discrete parts, connected to one another by a hinge 38 integral to either of the body 30 or cover 34. In still further embodiments, the body 30, cover 34, and hinge 38 may be all be separate and discrete parts assembled together to form the hanger tag 10.

Referring to FIGS. 1, 2, and 3, the body 30 includes a tag cavity 42, a hang hole 46, a post 50, and a locating profile 54 adjacent the post 50. The cover 34 includes a hang hole 58 and an aperture 62. In the illustrated embodiment, the cover 34 includes a rim 66, which helps to locate the cover 34 on the body 30 and seals the tag cavity 42 when the cover 34 is closed upon the body 30. The rim 66 is received within the tag cavity 42 such that the cover 34 is prevented from sliding translationally with respect to the body 30. As such, the rim 66 acts as secondary barrier or wall that encloses the tag cavity 42 when the cover 34 and the body 34 are engaged.

With reference to FIGS. 1 and 2, the tag cavity 42 is a recess formed in the body 30 and sized to accommodate a security tag or electronic article surveillance (EAS) label, such as a Sensormatic® Ultra-Strip® label (not shown). The dimensions of the tag cavity 42 may be tailored to suit the particular EAS label intended for use in the hanger tag 10. The hang holes 46, 58 of the body 30 and cover 34 are dimensioned to accommodate the particular merchandizing hooks with which the hanger tag 10 will be used to display products. As shown in FIGS. 1 and 2, the hang holes 46, 58 are rectangular in shape. In further embodiments, the hang holes 46, 58 may be of another shape, for example, round, square, or elliptical as dictated by the merchandizing display. In still further embodiments, the body 30 and cover 34 may include fewer or more hang holes 46,58 of the same or different geometries as dictated by the merchandizing display.

As shown in FIG. 1, the tag post 50 protrudes from the body 30 and includes a barbed end 70. As shown in FIG. 2, the barbed end 70 is sized to fit through an aperture 74 formed in a tang 78 of the saw blade 20. When the cover 34 of the hanger tag 10 is closed upon the body 30, the post 50 extends through the aperture 62 in the cover 34, thereby securing the saw blade 20 to the hanger tag 10. As shown in FIG. 3, the aperture 62 and barbed end 70 are sized with respect to one another so that once the barbed end 70 extends through the aperture 62 the cover 34 cannot be removed without damaging or destroying the hanger tag 10. In this regard, the hanger tag 10 reduces the likelihood of theft of an attached saw blade 20 because the saw blade 20 cannot be easily removed from the hanger tag 10 and the EAS label located within the hanger tag 10 cannot be tampered with. In further embodiments, the aperture 62 and barbed end 70 may be sized to permit the cover 34 to be secured to the body 30 and released from the body 30 multiple times without damage to the hanger tag 10.

Referring to FIGS. 1 and 2, the locating profile 54 forms a relief in the body 30 and has a depth equal to or slightly greater than a thickness of the saw blade 20 with which the hanger tag 10 is intended to be used. Together with the post 50, the locating profile 54 locates the saw blade 20 on the hanger tag 10 and prevents the blade 20 from moving relative to the hanger tag 10. As shown in FIG. 2, the geometry of the locating profile 54 follows the profile of the saw blade tang 78 of the saw blade 20 with which the hanger tag 10 is intended to be used, preventing the saw blade 20 from pivoting about the post 50.

In the illustrated embodiment, the locating profile 54 is such that a saw blade 20 may only be connected to the hanger tag 10 in one direction (i.e., saw teeth facing to the left). In further embodiments, the locating profile 54 may allow a saw blade 20 to be connected to the hanger tag 10 in more than one direction. In still further embodiments, the locating profile 54 may be designed to complement the profile of more than one saw blade tang 78, such that the hanger tag 10 can be used to hang and display more than one type of saw blade 20. In yet further embodiments, a depth of the locating profile 54 may be equal to or slightly greater than an integer multiple of the thickness of the saw blade(s) 20 with which the hanger tag 10 is to be used. For example, the depth of the locating profile 54 may be equal to two or three times the thickness of a blade 20, in order to accommodate two or three saw blades 20 on the hanger tag 10. In still further embodiments, the depth of the locating profile 54 may be greater or less than the thickness of the saw blade(s) 20 with which the hanger tag 10 is intended to be used. Accordingly, adjustments may be made to the cover 34 to accommodate the thickness of the blade(s) 20 to be attached to the hanger tag 10.

Figure 4:
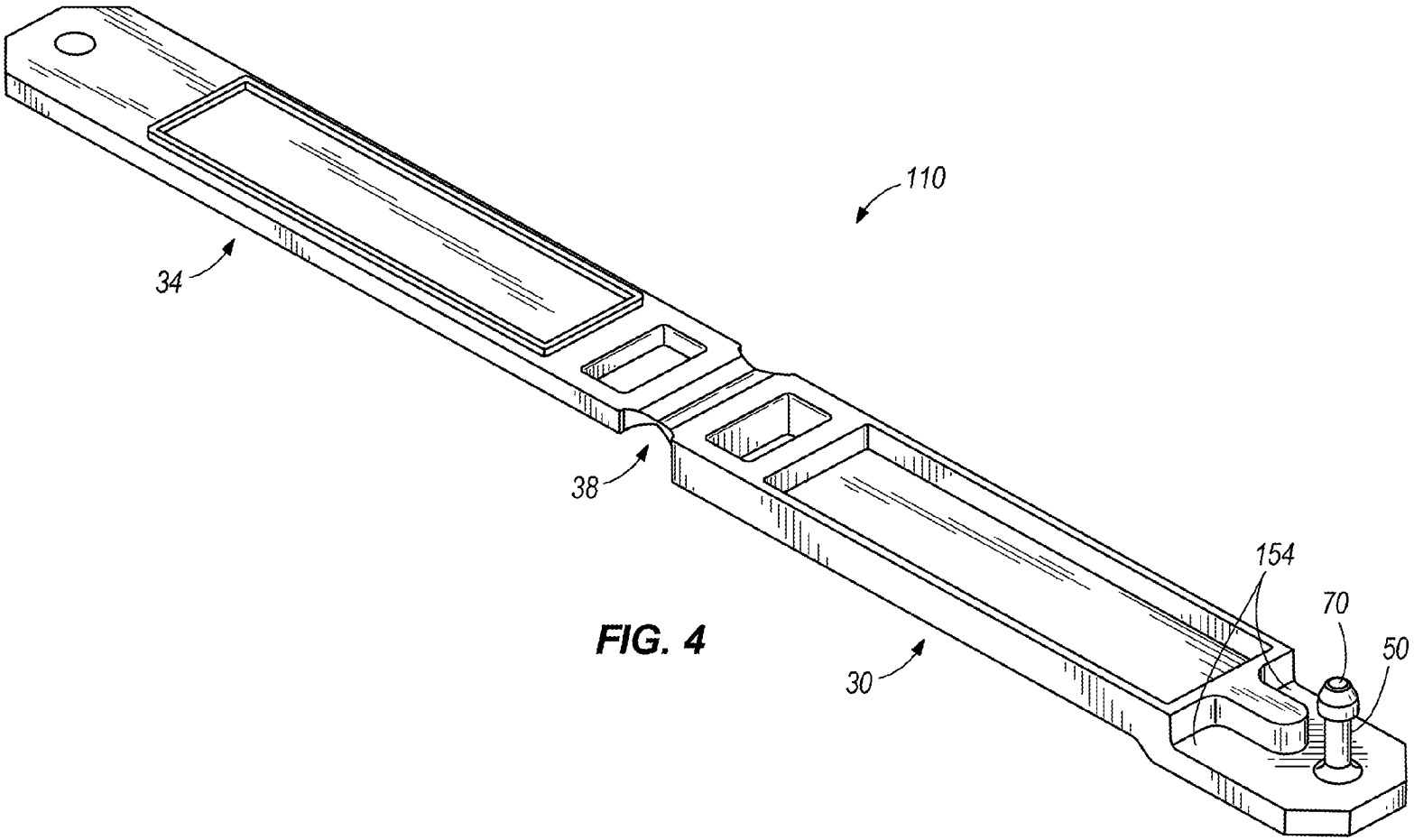
FIG. 4 illustrates a perspective view of a security hanger tag for a saw blade according to another embodiment of the invention.

FIG. 4 illustrates a hanger tag 110 according to another embodiment of the invention. Hanger tag 110 is substantially similar to the hanger tag 10 illustrated in FIGS. 1-3, and is designed to be used in a substantially similar manner; therefore, like structure will accordingly be labeled with like reference numerals. Discussion of the hanger tag 110 will be limited to the features that differ from those of hanger tag 10 discussed above.

With reference to FIG. 4, the locating profile 154 differs from the locating profile 54 discussed above with respect to hanger tag 10. In particular, locating profile 154 is symmetrical about a longitudinal axis of the hanger tag 110 such that a saw blade 20 may be attached to the hanger tag 110 in one of two directions (i.e., saw teeth to the left, or to the right). As discussed above with respect to hanger tag 10, in further embodiments the locating profile 154 may be designed to follow the profile of more than one saw blade tang 78, such that the hanger tag 110 can be used to hang and display more than one type of saw blade 20 (i.e., a double tang saw blade).

Although the embodiments of the hanger tag 10 and 110 have been described with respect to a reciprocating saw blade 20, the hanger tag 10 and 110 may be used on other types of saw blades, including jig saw and sabre saw blades. Further, the hanger tag 10 and 110 may be used to display and reduce the theft of commercial goods that are typically displayed on merchandising racks to permit visual and tactile inspection by consumers prior to purchase. Still further, the hanger tag 10 and 110 may be used to reduce the theft of commercial goods that are displayed in a box or bin (i.e., independent of a merchandising rack) to permit visual and tactile inspection by consumers prior to purchase.

Although particular constructions embodying independent aspects of the present invention have been shown and described, other alternative constructions will become apparent to those skilled in the art and are within the intended scope of the independent aspects of the invention. Thus, the invention provides, among other things, a device for securing and displaying saw blades. Various features and advantages of the invention are set forth in the following claims.

What is claimed is:

1. A device for securing and displaying a saw blade, the device comprising:
- a body portion including:
  - a first through hole adapted to receive a hanger;
  - a cavity for housing a security device; and
  - a locating profile;
- a cover including a second through hole;
- the body portion and the cover are one structure coupled by a hinge;
- a post extending from one of the body portion and the cover, and an aperture in the other of the body portion and the cover, the post being adapted to extend through the saw blade into the aperture to secure the saw blade to the device, the post being irremovable from the aperture without damaging the device; and
- the through holes being aligned when the post extends through the aperture, the aligned through holes adapted to house a security hanger.

2. The device of claim 1 further comprising one of a security tag or an electronic article surveillance label within the cavity.

3. The device of claim 2 further comprising a first state and a second state.

4. The device of claim 3 wherein in the first state the post extends through an aperture of a saw blade and the aperture in the body such that the cover is secured between a projection on a distal end of the post and the body portion thereby securing the saw blade to the security device.

5. The device of claim 4 wherein the locating profile houses a tang of the saw blade such that the saw blade cannot rotate about the post.

6. The device of claim 4 wherein in the first state the cover interfaces the body portion such that a rim fits within the cavity thereby preventing the removal of the one of the security tag or the electronic surveillance label.

7. The device of claim 3 wherein in the second state the cover does not interface the body portion.

8. The device of claim 3 wherein moving the device from the first state to the second state is not achievable without damaging the device.

9. A security and display device, the device comprising:
- a saw blade, the blade including a first aperture and a tang;
- a body including:
  - a locating profile;
  - a first through hole adapted to receive a hanger;
  - a post having a flange on a distal end;
  - a cavity for housing a security device;
  - a cover secured to the body by a hinge, the cover including:
    - a second through hole;
    - a rim that engages the cavity; and
    - a second aperture;
- the flange having a larger diameter than the second aperture;
- the post being adapted to extend through the first aperture of the saw blade into the second aperture to secure the saw blade to the device;
- the through holes being aligned when the post extends through the second aperture, the aligned through holes adapted to house a security hanger.

10. The device of claim 9 further comprising one of a security tag or an electronic article surveillance label within the cavity.

11. The device of claim 10 wherein the locating profile is sized to retain the tang of the blade while the post receives the aperture of the blade.

12. The device of claim 10 wherein the post extends through the first aperture and then the second aperture such that the flange prevents removal of the cover from the body thereby securing the blade between the body and the cover and preventing removal of the one of the security tag or the electronic article surveillance label.

13. The device of claim 12 wherein when the post receives the second aperture, the rim surrounds the cavity thereby creating a wall that prevents the removal of the one of the security tag or the electronic article surveillance label.

14. The device of claim 9 further comprising a second locating profile opposite the first.

* * * * *